US005914696A

United States Patent [19]

Vanderhelm et al.

[11] Patent Number: 5,914,696

[45] Date of Patent: Jun. 22, 1999

[54] UNBALANCED ANTENNA SYSTEM

[75] Inventors: Ronald J. Vanderhelm, Richmond; Larry J. Zibrik, Vancouver, both of Canada

[73] Assignee: Motorola, Inc., Schaumburg, Ill.

[21] Appl. No.: 08/927,761

[22] Filed: Sep. 11, 1997

Related U.S. Application Data

[63] Continuation of application No. 08/577,755, Dec. 22, 1995, abandoned.

[51] Int. Cl.[6] ..... H01Q 1/48

[52] U.S. Cl. ..... 343/841; 343/702; 343/846; 343/851

[58] Field of Search ..... 343/841, 851, 343/702, 829, 846, 848, 850, 722; H01Q 1/24

[56] References Cited

U.S. PATENT DOCUMENTS

| | | | |
|---|---|---|---|
| 2,920,323 | 1/1960 | Dunson | 343/847 |
| 3,541,556 | 11/1970 | Cheillan | 343/848 |
| 5,184,143 | 2/1993 | Marko | 343/848 |
| 5,420,599 | 5/1995 | Erkocevic | 343/702 |

OTHER PUBLICATIONS

The ARRL Handbook for the Radio Amateur, Published by the American Radio Relay League, 66th ed., pp. 2–22 to 2–29, Fig. 46, 1989.

IBM Technical Disclosure Bulletin, vol. 37, No. 06A, Jun. 1994, p. 483, PCMCIA Cellular/Radio Antenna.

*Primary Examiner*—Michael C. Wimer
*Attorney, Agent, or Firm*—James A. Lamb

[57] ABSTRACT

An antenna system (20) provides low radio frequency interference (RFI) using an unbalanced antenna (21) comprised of three eighths wavelength whip antenna element (22) and associated counterpoise (23). Antenna counterpoise (23) may be formed by an EMI shielding conductor which is isolated at the frequency of operation of antenna system (20) from EMI shielding serving as host interface ground conductor (28) using resonant structure (25). Resonant structure (25) isolates antenna counterpoise (23) from host interface ground conductor (28) thereby improving antenna efficiency, and substantially eliminating RFI effects arising from use of antenna system (20).

10 Claims, 2 Drawing Sheets

UNBALANCED ANTENNA SYSTEM

This is a continuation of application Ser. No. 08/577,755, filed Dec. 22, 1995 and now abandoned.

BACKGROUND OF THE INVENTION

This invention relates in general to communication systems, and more particularly, to antenna systems making use of unbalanced antennas.

Local area network (LAN) and wide area network (WAN) applications often place small dimensional requirements on antenna systems which interface with a host system such as a computer. Several LAN and WAN products are being developed to conform to dimensional standards set forth in the personal computer memory card interface association (PCMCIA) standard. These LAN and WAN products find application in host systems such as computers which communicate over a wireless network using RF transceivers accommodated by PCMCIA receptacles available in the host system.

Small dimensional requirements to which the transceivers are desired to conform often require the use of small dimensional antenna systems. A small and inexpensive type of antenna widely used is a monopole or whip antenna. This is an unbalanced antenna made up of a long, thin, radiating element or whip with an RF grounded counterpoise that essentially provides the electromagnetic equivalent to a reflection of the whip, and allows the whip to function efficiently as an antenna.

Electromagnetic interference (EMI) specifications typically require that the transceiver and the host interface of the transceiver with the host system be electromagnetically shielded. Shielding prevents undesired RF energy from the transceiver and the host interface from broadcasting and possibly interfering with other RF systems. Shielding is usually accomplished by enclosing RF components and subassemblies with a conductive material which makes electrical contact with the ground conductors of the transceiver, the host interface and the host system. The EMI shield may also provide the unbalanced antenna with the needed counterpoise.

A disadvantage of unbalanced antennas for use with a PCMCIA transceiver is that the antenna counterpoise, which is formed using the conductive enclosure of the EMI shield, conducts RF currents not only where desired on the antenna counterpoise, but also along the EMI shield of the host interface and in turn to the host. Such undesired currents may cause radio frequency interference (RFI) with the host system, and can possibly render the host system inoperative. Another disadvantage of the undesired currents conducted on other than the counterpoise is that the antenna efficiency degrades because of reduced current magnitude on the whip antenna.

One method which has been used with limited success as a solution to the RFI problem has been to adjust the length of the whip antenna. The operating mode of the of the whip antenna as controlled by adjusting the length of the antenna moves the region of highest current magnitude along the length of the whip antenna away from the antenna counterpoise. This has the effect of reducing the amount of RF current on the counterpoise and thus the EMI shielding. The effectiveness of this solution is sensitive to the host system and therefor requires modification of the antenna system to accommodate different host systems.

There remains therefore a need for a more efficient unbalanced antenna system, including one which more effectively isolates RF currents conducted on the RF ground of the antenna counterpoise from the shielding ground of the host interface.

DETAILED DESCRIPTION OF THE DRAWING

These problems and others are solved by the improved method and apparatus according to the invention. A presently preferred embodiment of the invention is a device with a low radio frequency interference (RFI) antenna system using an unbalanced antenna including a whip antenna element (preferably a three eighths wavelength whip) and associated counterpoise. The Antenna counterpoise may be formed by an EMI shielding conductor, which is isolated at the frequency of operation of antenna system from EMI shielding serving as host interface ground conductor, e.g., using a resonant structure. By use of this resonant structure, one advantageously isolates the antenna counterpoise from the host interface ground conductor, thereby improving antenna efficiency, and substantially eliminating RFI effects arising from use of antenna system.

Figure 1:
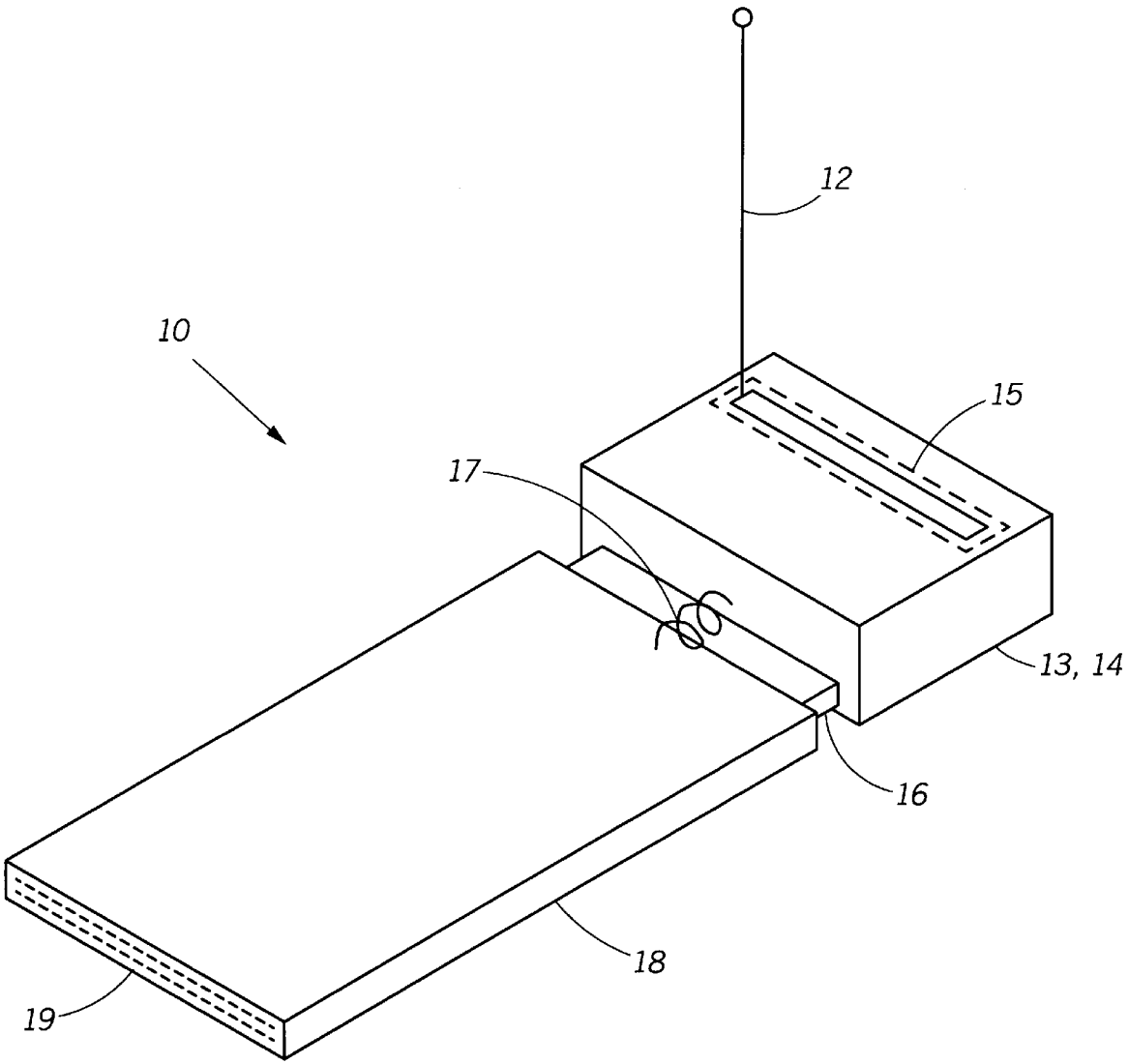
FIG. 1 is a perspective view of an unbalanced antenna system according to a first embodiment of the invention.

Turning now to FIG. 1, a first embodiment of a low radio frequency interference (RFI) antenna system 10 is illustrated. Major portions of the embodiment shown include a three-eighths wavelength whip antenna element 12 and a shielded enclosure 14. Enclosure 14 is shielded with a conductor which provides electromagnetic interference (EMI) shielding as well as serves as a counterpoise 13 for antenna element 12. Antenna system 10 further includes a shielded multilayered circuit board host interface, including connector 19. Shielding for the host interface is provided by a host interface ground conductor 18 which provides EMI shielding and shares ground connections with a host system (not shown) when connected to the host system with connector 19. A dielectric gap 16 separates antenna counterpoise 13 and host interface ground conductor 18, and an inductive reactance element 17 is connected across gap 16.

Figure 2:
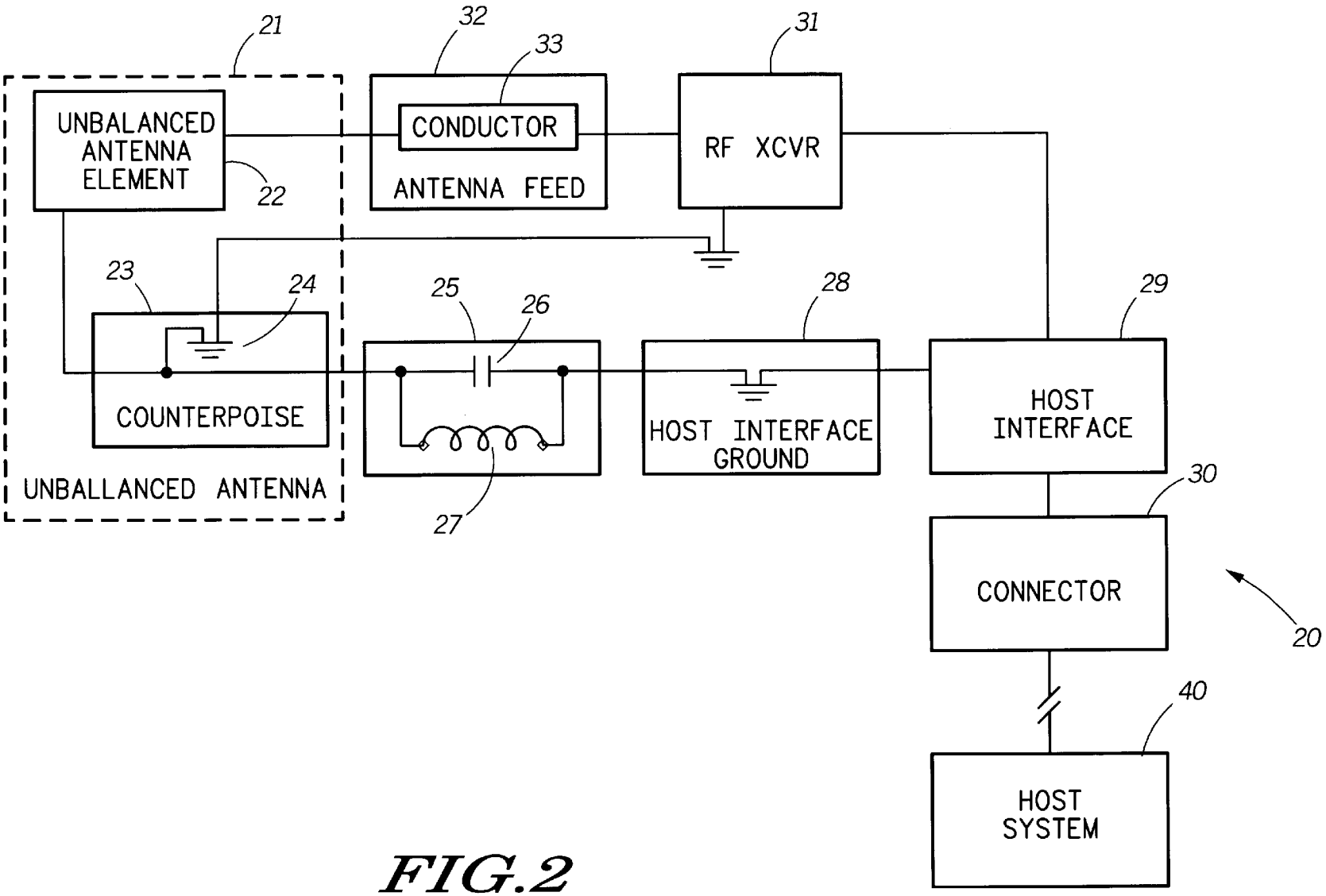
FIG. 2 is a block diagram of a further embodiment unbalanced antenna system.

Referring to FIG. 2, a block diagram of a further embodiment antenna system 20 is shown comprising unbalanced antenna element 22 and antenna counterpoise 23. In this embodiment unbalanced antenna element 22 is a monopole antenna element otherwise known as a whip antenna. The length of the whip antenna is preferably substantially three eighths of a wavelength at a frequency of operation of the unbalanced antenna 21. A feature of this embodiment is the use of a three eighths wavelength whip antenna element for potentially enhanced antenna gain and efficiency over a quarter wavelength antenna element.

Antenna counterpoise 23 is a conductive region which acts as an RF ground plane necessary for unbalanced antenna operation. Another feature of this embodiment is a conductive enclosure for electromagnetic interference (EMI) shielding which serves also as antenna counterpoise 23. An antenna feed 32 having a first conductor 33 coupled to unbalanced antenna element 22 also provides a radio frequency (RF) ground conductor 24 coupled to antenna counterpoise 23. In this embodiment, RF ground conductor 24 is coupled to antenna counterpoise 23 using a low loss conductive connection formed between antenna counterpoise 23 and RF ground conductor 24.

A host interface 29 having a host interface ground conductor 28 provides interface between antenna system 20 and a host system 40. In one preferred embodiment, host interface 29 dimensionally conforms to standards set forth by the Personal Computer Memory Card Interface Association (PCMCIA) for insertion into a PCMCIA-compliant slot in host system 40. In this embodiment, providing host interface ground conductor 28 as a conductor disposed on host interface 29 provides EMI shielding for host interface 29. Host interface ground conductor 28 connects with a host system ground to prevent antenna system 20 from building up static charge and posing an electrostatic discharge (ESD) damage threat to either antenna system 20 or host system 40.

A resonant element or structure 25 couples antenna counterpoise 23 to host interface ground conductor 28. Forming resonant structure 25 includes forming a capacitive reactance element 26 which electrically insulates antenna counterpoise 23 from host interface ground conductor 28 by separating antenna counterpoise 23 from host interface ground conductor 28 with a dielectric material. Forming resonant structure 25 also includes connecting antenna counterpoise 23 to host interface ground conductor 28 using an inductive reactance element 27. Inductive reactance element 27 provides a low loss conductive connection between antenna counterpoise 23 and host interface ground conductor 28. A feature of this embodiment is that capacitive element 26 is formed without using an additional component by separating the EMI shielding conductors associated with antenna counterpoise 23 and host interface ground conductor 28 with a dielectric material. The dielectric material may be the multilayer board assembly from which host interface 29 is assembled, e.g., extending beyond host interface ground conductor 28 into shielded enclosure 14 (see FIG. 1).

Referring again to FIG. 2, the operation of antenna system 20 is explained as follows. Antenna system 20 is shown with data and control signal lines coupled from a host system 40 to host interface 29 through connector 30. In the preferred embodiment the coupling of data and control lines is accomplished using a PCMCIA bus connector which couples host system 40 to host interface 29. Host interface 29 provides host interface ground conductor 28 which is connected to host system ground. Host interface ground conductor 28 serves as an EMI shield for circuitry contained in host interface 29 and may be common to ground conductors included with the data and control lines.

Data and control lines couple host interface 29 to an RF transceiver 31. The data lines conduct signals which can be baseband digital data from host interface 29 to be modulated by RF transceiver 31 onto a carrier frequency for transmission, or received demodulated data from RF transceiver 31 to host interface 29. Feed 32 interfaces RF transceiver 31 to unbalanced antenna 21. First conductor 33 couples RF signals to and from RF transceiver 31 and antenna element 22. RF ground conductor 24 connects RF ground of RF transceiver 31 and counterpoise 23 together. Antenna element 22 and counterpoise 23 form a monopole antenna for transmission and reception of RF signals.

Resonant structure 25 couples antenna counterpoise 23 to host interface ground conductor 28 such that at DC (direct current) a very low impedance is presented by resonant structure 25. At the frequency of operation of the unbalanced antenna, resonant structure 25 significantly presents an open circuit impedance. Using a dielectric to separate antenna counterpoise 23 from host interface ground conductor 28 electrically insulates antenna counterpoise 23 from host interface ground conductor 28 and forms a capacitor with a net capacitive reactance value at the frequency of operation of unbalanced antenna 21.

Conducted RF currents from antenna counterpoise 23 would be isolated from host interface ground conductor 28 by separating antenna counterpoise 23 from host interface ground conductor 28 without inductive reactance element 27. Displacement RF currents from counterpoise 23 would couple to host interface ground conductor 28 through capacitive reactance element 26 without inductive reactance element 27. Inductive element 27 has a net inductive reactance value at the frequency of operation of unbalanced antenna 21. Together, capacitive reactance element 26 and inductive reactance element 27 combine in parallel to form a parallel resonant circuit at the frequency of operation of unbalanced antenna 21.

Setting a magnitude of inductive reactance value equal to a magnitude of capacitive reactance value at the frequency of operation of unbalanced antenna 21 substantially isolates antenna counterpoise 23 from host interface ground conductor 28 at the frequency of operation. Isolating both conducted and displacement RF currents from host interface ground conductor 28 prevents radio frequency interference to host system 40. A feature of this embodiment is that connection of inductive reactance element 27 across capacitive element 26 provides a low impedance DC connection between antenna counterpoise 23 and host interface ground conductor 28. A low impedance DC connection prevents excessive static charge from building up between antenna counterpoise 23 and host interface ground conductor 28 which can cause electrostatic discharge damage to either host system 40 or antenna system 20 or both.

The method of enhancing antenna system efficiency and reducing antenna system radio frequency interference with host system 40 using unbalanced antenna 21 includes confining conducted RF ground currents to antenna counterpoise 23, coupling antenna counterpoise 23 with host interface ground conductor 28, and isolating displacement RF ground currents and conducted RF ground current from host interface ground conductor 28 at the frequency of operation of antenna system 20. Confining conducted RF ground current to antenna counterpoise 23 improves antenna efficiency by preventing conducted RF current from flowing away from antenna counterpoise 23 to areas which would not contribute to antenna efficiency.

Coupling antenna counterpoise 23 with host interface ground conductor 28 follows from confining conducted RF ground current to antenna counterpoise 23. When antenna counterpoise 23 is separated from host interface ground conductor 28, conducted ground current is confined to antenna counterpoise 23, but displacement current can be coupled from antenna counterpoise 23 to host interface ground conductor 28 through a dielectric separating antenna counterpoise 23 and host interface ground conductor 28.

Isolating conducted and displacement ground current from host interface ground conductor 28 is accomplished by forming a parallel resonant structure which presents a very high impedance to RF current at the frequency of operation of antenna system 20. It is to be appreciated that resonant structure 25 is not limited to formation with a discreet inductor for inductive reactance element 27. Any resonant structure having a very low impedance at DC and a very high impedance at the frequency of operation of antenna system 20 may be used.

Antenna system 20 provides a low radio frequency interference (RFI) antenna system using unbalanced antenna 21 (e.g., a three eighths wavelength whip antenna element 22, and associated counterpoise 23). Antenna counterpoise 23 may be formed by an EMI shielding conductor which is isolated at the frequency of operation of antenna system 20, from EMI shielding serving as host interface ground conductor 28, using resonant structure 25. Resonant structure 25 isolates antenna counterpoise 23 from host interface ground conductor 28, thereby improving antenna efficiency, and substantially eliminating RFI effects arising from use of antenna system 20.

While the invention has been described in conjunction with specific embodiments thereof, it is evident that many alterations, modifications, and variations will be apparent to those skilled in the art in light of the foregoing description. For example, while resonant circuit 25, RF transceiver 31, interface 29, and other circuits/elements, are described in terms of specific logical/functional circuitry relationships, one skilled in the art will appreciate that such may be implemented in a variety of ways, such as appropriately configured and programmed processors, ASICs (application specific integrated circuits), DSPs (digital signal processors), and hardware components, some combination thereof, or even a distributed architecture with individual elements physically separated but cooperating to achieve the same functionality. Further, it should be understood that for purposes of this application a first device or component is responsive to, coupled to, or in communication with a second unit or component regardless of whether the first and second units are directly coupled or indirectly coupled, such as via intermediate units, including switches that operatively couple the units for only a segment of time, as long as a signal path can be found that directly or indirectly establishes a relationship between the first and second units. Moreover, the invention is not limited to the illustrated application, but has applicability to any wireless data system. Thus, it should be understood that the invention is not limited by the foregoing description of preferred embodiments, but embraces all such alterations, modifications, and variations in accordance with the spirit and scope of the appended claims.

We claim:

1. An antenna system for reducing radio frequency interference, the antenna system to be used in association with a personal computer memory card, the antenna system comprising:

an unbalanced antenna having an unbalanced antenna element and an antenna counterpoise coupled to the unbalanced antenna element;

an antenna feed having a first conductor coupled to the unbalanced antenna and having a radio frequency ground element coupled to the antenna counterpoise;

a host interface having a host interface ground element coupled to and integrally mounted with the antenna counterpoise;

a resonant element which couples the host interface ground element to the unbalanced antenna, the resonant element electrically insulating the unbalanced antenna from the host interface ground element at a frequency of operation; and the resonant element is embodied within the personal computer memory card and further comprises:

a capacitive element which electrically insulates the antenna counterpoise from the host interface ground element and has a net capacitive reactance value at the frequency of operation; and an inductive element which provides a low loss conductive connection between the antenna counterpoise and the host interface ground element and has a net inductive reactance value at the frequency of operation.

2. The antenna system of claim 1 wherein the antenna counterpoise further comprises:

a low loss conductive material in the form of a protective enclosure for electromagnetic interference shielding;

a matching network within the protective enclosure which is coupled to the unbalanced antenna; and a low loss conductive connection between the antenna counterpoise and the radio frequency ground element.

3. The antenna system of claim 1 wherein the inductive element and capacitive element embodied in the personal computer memory card have reactance values which when the inductive element and the capacitive element combine in parallel result in a parallel resonant circuit at the frequency of operation, thereby substantially isolating the antenna counterpoise from the host interface ground element.

4. An antenna system for reducing radio frequency interference in an unbalanced antenna having an unbalanced antenna element and an antenna counterpoise, the unbalanced antenna integrally mounted on a personal computer memory card, the antenna system comprising:

a host interface having a host interface ground element;

an insulated gap positioned between the antenna counterpoise and the host interface ground element, the insulated gap electrically insulates the antenna counterpoise from the host interface ground element and the antenna counterpoise, host interface ground element and insulated gap form a capacitive element having a net capacitive reactance value at a frequency of operation associated with the unbalanced antenna; and an inductor coupled between the host interface ground element and the antenna counterpoise, the inductor providing a low loss conductive connection between the antenna counterpoise and the host interface ground element and has a net inductive reactance value at the frequency of operation.

5. An antenna system as defined in claim 4, wherein the antenna counterpoise comprises a first electromagnetic interference shield and the unbalanced antenna element is mounted on the first electromagnetic interference shield.

6. An antenna system as defined in claim 5, wherein the host interface ground element comprises a second electromagnetic interference shield.

7. An antenna system as defined in claim 6, wherein the first and second electromagnetic interference shields and the insulated gap positioned between the first and second electromagnetic interference shields form the capacitive element.

8. An antenna system as defined 7, wherein the inductor and capacitive element have reactance values which result in a parallel resonant circuit at the frequency of operation associated with the unbalanced antenna which substantially isolates the antenna counterpoise from the host interface ground element.

9. An antenna system as defined in claim 4, wherein the insulated gap is formed using a multilayer board assembly.

10. An antenna system as defined in claim 7, wherein the capacitive element and inductor are coupled in parallel between the host interface ground element and the antenna counterpoise.

* * * * *